US011352721B2

(12) United States Patent
Hufenbach

(10) Patent No.: US 11,352,721 B2
(45) Date of Patent: Jun. 7, 2022

(54) CIRCULAR LOOM WITH ORBIT PATH

(71) Applicant: INNOTEC LIGHTWEIGHT ENGINEERING & POLYMER TECHNOLOGY GMBH, Goslar (DE)

(72) Inventor: Werner Hufenbach, Dresden (DE)

(73) Assignee: INNOTEC LIGHTWEIGHT ENGINEERING & POLYMER TECHNOLOGY GMBH, Goslar (DE)

( * ) Notice: Subject to any disclaimer, the term of this patent is extended or adjusted under 35 U.S.C. 154(b) by 141 days.

(21) Appl. No.: 16/935,381

(22) Filed: Jul. 22, 2020

(65) Prior Publication Data

US 2021/0025087 A1 Jan. 28, 2021

(30) Foreign Application Priority Data

Jul. 24, 2019 (DE) ..... 102019120035.0
Jul. 24, 2019 (DE) ..... 102019120037.7

(51) Int. Cl.

| | |
|---|---|
| ***D03D 37/00*** | (2006.01) |
| ***D03D 49/52*** | (2006.01) |
| ***D03D 51/02*** | (2006.01) |
| ***D03D 27/02*** | (2006.01) |
| *D03D 41/00* | (2006.01) |

(52) U.S. Cl.

CPC ..... *D03D 37/00* (2013.01); *D03D 27/02* (2013.01); *D03D 49/52* (2013.01); *D03D 51/02* (2013.01)

(58) Field of Classification Search

CPC ..... D03D 37/00; D03D 27/02; D03D 49/52; D03D 51/02; D03C 13/00

See application file for complete search history.

(56) References Cited

U.S. PATENT DOCUMENTS

| | | | | |
|---|---|---|---|---|
| 920,728 | A | 5/1909 | Chernack | |
| 3,749,135 | A * | 7/1973 | Linka | D03D 47/267 139/458 |
| 3,871,413 | A * | 3/1975 | Torii | D03D 37/00 139/459 |
| 3,961,648 | A * | 6/1976 | Torii | D03D 37/00 139/458 |
| 4,234,021 | A * | 11/1980 | Clokie | D03D 51/34 139/371 |

(Continued)

FOREIGN PATENT DOCUMENTS

| | | | |
|---|---|---|---|
| CN | 1308153 | A | 8/2001 |
| FR | 2030124 | A1 | 10/1970 |

(Continued)

*Primary Examiner* — Robert H Muromoto, Jr.
(74) *Attorney, Agent, or Firm* — Abel Schillinger, LLP

(57) ABSTRACT

A circular loom for weaving a weaving core along a weaving axis with at least one shuttle, which comprises a weft thread spool and is movable along a circular orbit path around the weaving core. The orbit path is formed of first track segments arranged one after the other along its circumference and at least one movably arranged or designed guide device is provided, which guides at least one warp thread provided from a warp thread spool on a warp spool device and on which at least a first track segment of the orbit path and at least a second track segment alternatively assignable to the orbit path are arranged and guided, where in the guided absence of the first and second track segment from the orbit path the guided warp thread, crossing the track plane, passes through the orbit path.

12 Claims, 8 Drawing Sheets

(56) References Cited

U.S. PATENT DOCUMENTS 4,316,488 A * 2/1982 Manini ..... D03D 37/00 139/458
4,355,666 A * 10/1982 Torii ..... D03D 51/40 139/458
4,424,836 A * 1/1984 Torii ..... D03D 37/00 139/457
4,432,397 A * 2/1984 Cacciapuoti ..... D03D 37/00 139/458
4,479,517 A * 10/1984 Plammer ..... D03D 37/00 139/436
4,509,562 A * 4/1985 Schonberger ..... D03D 37/00 139/457
4,619,293 A * 10/1986 Huemer ..... D03D 49/62 139/458
4,658,862 A * 4/1987 Huemer ..... D03D 51/002 139/457
4,719,946 A * 1/1988 Buchinger ..... D03D 37/00 139/458
4,776,371 A * 10/1988 Schonberger ..... D03D 37/00 139/458
4,977,933 A * 12/1990 Brais ..... D03D 37/00 139/15
5,099,891 A * 3/1992 Hiramatsu ..... D03D 37/00 139/457
5,293,906 A * 3/1994 Amin ..... D03D 37/00 139/309
5,617,905 A * 4/1997 Ziegler ..... D03D 37/00 139/459
10,711,376 B2 * 7/2020 Hufenbach ..... D03D 37/00
2019/0153637 A1 * 5/2019 Hufenbach ..... D03D 37/00
2021/0025087 A1 * 1/2021 Hufenbach ..... D03D 37/00
2021/0032784 A1 2/2021 Hufenbach

FOREIGN PATENT DOCUMENTS

FR 2339009 A1 8/1977
JP H01168938 A 7/1989
WO 2017190739 A1 11/2017

* cited by examiner

CIRCULAR LOOM WITH ORBIT PATH

CROSS-REFERENCE TO RELATED APPLICATIONS

The present application claims priority under 35 U.S.C. § 119 of German Patent Application Nos. 102019120035.0 and 102019120037.7, both filed on Jul. 24, 2019, the entire disclosures of which are expressly incorporated by reference herein.

BACKGROUND OF THE INVENTION

1. Field of the Invention

The invention relates to a circular loom for weaving a weaving core with at least one shuttle, which has a weft thread spool and is movable along a circular orbit path around the weaving core.

2. Discussion of Background Information

Known circular looms and weaving processes on circular looms are used in the production of hollow-profile, tubular textiles for items such as fire hoses, water hoses, sacks or wheel rims, etc.

A circular loom of the above-stated type is known from publication WO2017/190739 A1, the entire disclosure of which is incorporated by reference herein.

One or more shuttles, each with a weft thread spool, are moved along a circular orbit path, guiding the weft thread in a circuit around the weaving core.

Furthermore, such circular looms are equipped with warp spool devices. Warp spool devices essentially have, in addition to a warp thread spool with warp thread, a holder for the warp thread spool (warp spool holder) and a thread tensioning device.

The warp spool devices are arranged directly adjacent to a weaving plane that is radially enclosed by the circular orbit path and determined by the circumferential course of the weft thread around the weaving core.

The warp spool devices are designed to be movable, with the movement path of the warp spool devices taking place through the weaving plane in order to create what is known as a shed of the warp threads as a result of their changing positioning and to generate a weave with the weft thread. This largely eliminates a separate thread guide or thread deflector for the warp threads.

With this circular loom, by applying high thread tension to the weft threads and warp threads it is possible to generate a fabric that sits tightly on the weaving core and is of high weaving quality and weaving variability.

Experience shows, however, that the maneuverability of the warp spool devices through the weaving plane is constructively extremely complex, while in particular also the maintenance of an even thread tension while moving the warp spools relative to the weaving plane and to the weaving core places high technical demands on the design of the circular loom.

In addition, the movement of the warp spool devices requires increased mechanical and control-technology complexity. In addition to the necessary controlling of an acceleration and braking procedure for the really large masses, the rapid movement of the warp spool devices and the rapid exit of the warp spool devices and their positioning devices from the weaving plane means high constructive complexity for the passing of the weft thread spool, with the movement times and exit times limiting the maximum possible speed of the weft thread spool.

In the case of the circular loom according to publication FR 2339009 A1, the entire disclosure of which is incorporated by reference herein, the warp spool devices are pivotably mounted on a peripheral housing, while the warp threads are alternately fed in a fanned out manner—by the thread guide tubes crossing in alternating directions the track for the orbit of the shuttles—to the weaving core or rather the weaving plane by means of thread guide tubes that are connected to the pivotable warp spool devices. For this purpose, the track is formed with wide slots in it for the thread guide tubes to pass through, whereby the thread guide tubes assume their changing positions along the slots.

This circular loom also requires a complicated mechanical and control-technology design for the movement of the warp spool devices, with the speed of the shuttles being limited by the transition times of the thread guide tubes.

In addition, the pivoting of the thread guide tubes, in which the warp thread is guided at different angles to the outlet of the thread guide tube and rubs on the inner wall of the tube, results in not inconsiderable abrasion of the thread. Because of this risk of damage, circular looms of this kind are not suitable for processing particularly delicate threads such as carbon fibres. This largely prevents the use of these circular looms for producing fibre preforms for fibre-composite products.

As the thread guide tubes pivot in a circular arc, the thread tension of the warp thread near the weaving point decreases considerably, which in addition to a very loose fabric can also result in a messy weave pattern with tangling.

Relatively large slots or gaps have to be provided to let the thread guide tubes through the track, with the result that these track interruptions cause the shuttles to pass very bumpily over the slits resulting in a very inhomogeneous orbit of the shuttle, which in turn leads to unwanted vibrations in the circular loom and to further fluctuations in thread tension.

In view of the foregoing, it would be advantageous to have available an improved circular loom which eliminates the disadvantages of the prior art and enables higher weaving productivity, in particular by simpler constructive means.

Furthermore, it would be desirable to ensure improved functionality of the circular loom for producing a hollow-profile fabric of high weaving quality and weaving variability.

SUMMARY OF THE INVENTION

The present invention provides a circular loom for weaving a weaving core with at least one shuttle, which comprises a weft thread spool and is movable along a circular orbit path around the weaving core wherein the orbit path is formed of first track segments arranged one after the other along its circumference and at least one movably arranged or designed guide device is provided, which guides at least one warp thread provided from a warp thread spool of a warp spool device and on which at least one first track segment of the orbit path and at least one second track segment that is alternatively assignable to the orbit path are arranged and guided, where in a guided absence of the first and second track segment from the orbit path the guided warp thread, crossing the track plane, passes through the orbit path, according to which the orbit path is formed of first track segments arranged one after the other along its circumference and at least one movably arranged or designed guide device is provided, which guides at least one warp thread provided from a warp thread spool of a warp spool device, and on which at least one first track segment of the orbit path and at least one second track segment alternatively assignable to the orbit path are arranged and guided, where in the guided absence of the first and second track segment from the orbit path the guided warp thread, crossing the track plane, passes through the orbit path.

One or more shuttles move with their weft thread spools along the circular orbit path, which may for example be formed mechanically or electromagnetically, and which determines the conveying or guiding line for the concentric conveying or guiding of the shuttle around the weaving core.

The shuttle(s) can actively, e.g. preferably by means of its/their own direct drive, move along the orbit path, or the shuttle(s) can be passively, e.g. by means of an externally driven, mechanical carrier or by means of an electromagnetic drive, conveyed and steered along the orbit path.

In relation to the axially directed weaving axis of the circular loom, the circular orbit path is preferably arranged aligned radially (perpendicular to the weaving axis), as a result of which the circular loom has a particularly slender design.

For particular applications of the circular loom, however, it may be advantageous to arrange the circular orbit path quasi-radially (at an angle to the weaving axis which is not equal to 90°).

The radially outer circumference of the circular orbit path forms the radial boundary of the track plane of the circular loom, within which the orbit of the shuttle(s) with the weft thread is effected. The axially outer width of the circular orbit path forms the axial boundary of the track plane of the circular loom, within which the orbit of the shuttle(s) with the weft thread is effected. The outer boundary points of the circular orbit path describe the track plane essentially as a circular disc.

The guide device according to the invention is preferably located outside the track plane and is movably arranged or movably designed in fixed arrangement, where preferably only the track segments from or rather in the orbit path (track plane) that are carried with the guide device are conveyed and the warp thread guided by the guide device crosses the track plane of the orbit path during the absence of a track segment from the orbit path.

However, components or aids of the guide device, e.g. aids for guiding the track segments and/or the warp thread, can also cross the track plane of the orbit path.

The moving guide device can be fastened to or movably mounted on e.g. a radial outer wall of the machine housing of the circular loom or on the radially outer circumference of the circular orbit path.

Preferably several guide devices are arranged around the circumference of the circular orbit path.

The guide device according to the invention carries with it firstly at least a first and a second track segment in a pair, in order in an alternating travel movement to be able to replace the first track segment of the orbit path with the second, alternative track segment and vice versa, and thus be able to complete the orbit path in each change position.

Secondly, the guide device according to the invention performs the guiding and alternate positioning of at least one warp thread (warp thread guide) between its provision by the warp spool(s) of the warp spool device(s) and its weaving with the weft thread at a weaving point on the weaving core.

The weaving point describes the moving point at which temporarily the warp threads are woven with the weft threads on the surface of the weaving core.

The circular orbit path according to the invention is designed as a series-arrangement of many individual circular-arc-shaped track segments and therefore has a multi-part/segmented design. In each case one track segment of the orbit path and a second track segment assigned to this first track segment are arranged on the movable guide device and guided by it in such a way that these too, like the guided warp thread, undergo a change of position by means of the guide device.

The track segments of the orbit path are referred to as first track segments; the substitute track segments assigned preferably in the same number to the first track segments of the orbit path are described as second track segments.

The second track segment arranged on the guide device is designed in interaction with the alternatingly moving guide device as a temporarily acting substitute track segment for the first track segment of the circular orbit path. During the alternating changeover movement of the guide device, the second track segment briefly replaces the first track segment in the circular orbit path, where during the phase of swapping the track segments a positioning of the track segments concerned takes place outside of the track plane and in this absence of the track segments from the orbit path a discontinuity interrupting the orbit path temporarily arises, which the warp thread carried by the guide device can use to cross the temporarily interrupted orbit path, or rather the track plane. Upon completion of a changeover movement of the guide device, the warp thread has changed the side of the orbit path and the orbit path is alternatively closed by the second track segment, while subsequently the shuttle(s) can run through the closed orbit path unimpeded.

The temporary discontinuity in the orbit path is a local interruption, generated along the circumference of the orbit path, of the track segments of the orbit path, which otherwise are homogeneously arranged one after the other, by a temporarily missing track segment.

The discontinuity can be an objectively completely empty space (void) along the orbit path; however for example components or aids of the orbit path, such as guide elements for guiding the track segments, or components or aids of the guide device, e.g. for guiding the track segments and/or the warp thread, can be temporarily present at the discontinuity.

Preferably a first and a second track segment are guided as a pair and together with a warp thread intermediately arranged between the track segment pair by means of the guide device, and designed as a guided unit.

In each case one guide device can be provided for guiding in each case one track segment pair and one warp thread (guided unit) or in each case one guide device can be provided for guiding several track segment pairs and/or several warp threads.

Each guide device can be moved relative to an adjacently arranged guide device, as a result of which also the first track segments can be moved relative to each other and also the second track segments can be moved relative to each other.

In particular, the guide device acts separately from the design and function of the warp spool device(s).

While the warp threads are being moved and guided by the guide device(s), the required thread tension on the warp threads is essentially maintained by the thread tensioning device of the warp spool devices, where the positioning of the warp spool devices can be stationarily and locally variable.

Thus the warp spool devices may be stationarily arranged, e.g. fixed to part of the housing of the circular loom, or alternatively they may be movably arranged in various positions in relation to the housing of the circular loom.

The warp spool devices are preferably located in the immediate vicinity of the track plane so that the warp threads can be guided to the weaving point on the weaving core on paths that are as short as possible.

In each case one guide device may be provided for guiding in each case one warp thread from a warp spool device, or in each case one guide device may be provided for guiding several warp threads from a group of involved warp spool devices.

If a group of warp spool devices is provided, which is assigned to a guide device, then these warp spool devices, in relation to the direction of guiding the warp threads leading to the guide device, may be arranged next to each other, behind each other, or above each other.

If the guide devices are provided in the same number as the warp spool devices being operated on the circular loom, and functionally assigned to these in each case, then each warp thread will be guided separately by a guide device in each case.

By means of the movable guide device(s), the warp threads drawn from the warp thread spools can—without needing to move the warp spool devices—be brought over short distances, quickly, and with little complexity to both sides of the orbit path and hence of the track plane, where a warp thread carried by the guide device successively crosses the track plane, by the warp thread as it leaves the guide device for example via a thread outlet crossing the circular orbit path at a discontinuity between the track segments of the orbit path which is temporarily generated during the removal of a track segment of the orbit path from the track plane.

In this way, the warp threads on both sides of the track plane can be e.g. alternately spread and fanned out in opposite directions, in order to form a warp thread shed while maintaining a high thread tension, while in the alternating positions of the warp threads located outside the track plane, the passage of the shuttle(s) along the temporarily closed orbit path is ensured, as a result of which an undulation/weaving of the warp threads with the weft thread going through the warp thread shed, which is drawn from the weft thread spool of the shuttle that is carried along the orbit path, takes place on the weaving core.

According to the sequence and the operating cycles in which by means of the guide device(s) one or more track segment pair(s) and one or more warp threads alternatingly change their position and the shuttle(s) pass through the temporarily closed orbit path, weave patterns of all different kinds can be formed on the weaving core being woven.

With the design of the circular loom according to the invention, because of a constructively and spatially compact design of the warp thread transport for the rapid alternating and fanning out of the warp threads in combination with the flexible changeover design of the orbit path for constantly ensuring an undisturbed orbit of the shuttles, the weaving process can be significantly accelerated and higher productivity achieved.

The arrangement of the first and second track segments can be designed as far as possible close together and in particular the warp thread outlet designed between the first track segment and the second track segment can be designed so close to the orbit path, or rather to the lateral, axial boundary of the track plane, that in the alternating positions assumed by the warp threads the passage of the shuttles is ensured just still without touching the warp thread, as a result of which the swapping of the track segments, the change of warp thread positions and the orbit of the shuttles can accordingly take place more quickly, which accelerates the weaving process and further increases the productivity of the circular loom.

The possibility of positioning the warp threads close to the orbit path also means that the warp threads run at a very flat angle (weaving angle) relative to the extension of the track plane, with the result also because of the spatially compact change of position that the thread tension of the warp threads remains largely constant to the benefit of a high weave quality.

Furthermore, the contact-free and deflection-free guidance and passage of the warp threads through the orbit path achieves gentle handling of the warp thread material so that even delicate thread materials such as carbon fibres can be readily processed.

The first track segments of the circular orbit path and likewise also the alternatively assignable second track segments, seen in the direction of the circumference of the orbit path can be arranged one after the other approximately flushly and nearly gap-free, and in their movement relative to one another can be e.g. designed movably slidably against each other.

The nearly gap-free design of the orbit path enables very smooth and fast running of the shuttle(s), so that the orbit of the shuttle(s) in the orbit path at high speed can take place nearly vibration-free and hence while maintaining a high thread tension, and the above-mentioned productivity and quality increase can be further improved.

The result is that at a very high operating speed with high thread tension of the weft threads and warp threads, a tightly sitting fabric of improved weave quality can be generated on the weaving core.

Due to the feasibility of a stably high thread tension for the weft threads and the warp threads, the circular loom according to the invention is particularly suitable for weaving weaving cores with changing cross-sectional geometry in the axial extension (in the direction of the rotational axis of the weaving core (weaving core axis)), since the tightly woven threads can conform to the contour of a changing weaving core contour.

To weave such a contoured weaving core with a fabric remaining stationary, the weaving core is moved along the weaving axis of the circular loom so that the complete contour of the weaving core can be woven. The weaving point, at which the warp threads are woven with the weft threads on the surface of the weaving core moves not only around the circumference of the rotating weaving core but also along its weaving core axis.

The rotational axis of the weaving core (weaving core axis) is preferably designed to be congruent with the weaving axis of the circular loom so that the weaving core is moved in the direction of its rotational axis (weaving core axis) along the congruent weaving axis of the circular loom.

However, the rotational axis of the weaving core (weaving core axis) can for weaving and moving the weaving core along the weaving axis of the circular loom also be arranged at an angle to the weaving axis of the circular loom in order to be able to generate a variable angular position of the warp threads and weft threads on the weaving core and hence a changing thread tension.

Due to the advantages described above, the circular loom according to the invention is also suitable for the production of hollow-profile, fibrous woven preforms of fiber composite products e.g. for the production of woven preforms for wheel rims made of fiber composite materials.

Advantageous designs and further developments of the circular loom arise from the dependent patent claims, the following description, and the associated drawings.

According to an advantageous design of the circular loom, in each case a first track segment of the orbit path and a second track segment alternatively assignable to the orbit path are designed identically to each other.

The identical design of the second track segment—a track segment replacing the first track segment of the orbit path—homogenizes the design of the resulting alternatively closed orbit path, and improves the running characteristics and smooth running of the shuttle running along the circular orbit path.

According to a further advantageous design of the circular loom, the guide device has at least one movably or pivotably arranged or designed positioning part.

At least one first and one second track segment can be arranged on the positioning part.

The positioning part can be moved or pivoted in an alternating manner by means of appropriate constructive design of the guide device relative to a base body of the guide device or relative to the machine housing of the circular loom or relative to the circular orbit path, and at the same time carry the first and second track segment with it.

It is also possible for several track segment pairs comprising first and second track segment to be connected with a positioning part.

The guide device and/or the positioning part can furthermore preferably be equipped with at least one thread guide element.

The thread guide element of the guide device is provided for the actual steering and guiding of at least one warp thread in its alternating movement, and it guides with it a warp thread or several threads being drawn from the warp thread spool(s), if necessary also with a thread deflector.

The thread guide element can be connected to the positioning part or be designed so that it is integrated into the positioning part.

One or more thread guide element(s) can be arranged or designed on the positioning part of the guide device.

The warp thread can also be guided and positioned by means of a guide device positioning part that directly carries a warp thread spool, as a result of which a thread guide element or a thread outlet may be unnecessary.

The guide device may also have several positioning parts, possibly with one or more thread guide elements for guiding and steering in each case one or more warp threads.

Preferably according to a constructively favourable embodiment the thread guide element is designed as a thread guide channel, a thread guide groove, or as a thread guide eye, through which in each case the warp thread is passed.

The thread guide element can axially or radially guide the warp thread and end with a thread outlet for the warp thread.

An outlet opening at the exit of the guided warp thread from the thread guide element of the positioning part is referred to as a thread outlet.

Preferably for guiding the warp thread the thread guide element can be arranged and designed on or in a movably or pivotably mounted positioning part of the guide device.

The positioning part of the guide device may for example be a movable guide carriage or a pivotable guide arm or a rotatable guide cylinder, on which the track segment pair(s) are arranged and furthermore one or more thread guide element(s) are arranged or designed. The rotatable guide cylinder can have e.g. the track segment pair(s) and furthermore one or more thread guide element(s) in a revolver arrangement.

In the case in particular of the first and second track segments arranged on the positioning part at a defined distance to each other, it may prove advantageous that these track segments are arranged parallel to and spaced apart from each other in such a way that besides a resulting space saving in the circular loom, the assignment of the second track segment to the orbit path as a substitute for the first track segment can take place with particularly little positioning effort.

Preferably the movement or pivoting of the positioning part and furthermore of the carried track segments and the guided warp thread takes place parallel to the weaving axis or with the rotary axis perpendicular to the weaving axis of the circular loom.

This results in the moving or pivoting path of the swappable track segments and the thread guide path of the warp threads being essentially perpendicular to the track plane of the orbit path.

As a result, the path and the travel time of the track segments being swapped and the path and travel time of the warp threads to cross the track plane can be shortened, in such a way that the track segment swap speed and the changeover speed of the warp threads and hence the circular speed of the shuttles can be increased.

According to an advantageous design, the positioning part of the guide device is designed to be linearly movable, as a result of which furthermore the carried track segments and the guided warp thread is linearly moved/guided.

Linear movability of the positioning part, or rather the movement or sliding of a guided unit e.g. comprising positioning part, first and second track segment and warp thread guide can be implemented relatively simply constructively and in terms of control technology.

In terms of drive technology, direct drives, preferably linear drives, can be used. These can be located e.g. on the positioning part, on the base body or on the machine housing and for example can be operated pneumatically by pneumatic cylinders or electrically by electric motors, whereby each positioning part can be driven individually.

The alternating movement of the positioning part can be generated and controlled by means of special switchable direct drives that act in two directions, e.g. by means of a rack or threaded rod.

These drives can achieve powerful acceleration, braking and quick switching in operation and hence effect a rapid change in direction of the positioning part.

The guidance and/or the drive of the positioning part can also be designed to be magnetic and/or electromagnetic.

In addition, a linear movement of the warp thread results in lower thread tension losses than in non-linear movements of the warp threads, which further improves the quality of the woven product.

Preferably the linear movability of the positioning part and of the carried track segments and the guided warp thread is designed in the axial direction along the weaving axis of the circular loom, which results in the travel path of the track segments and the path of the guided warp thread being exactly perpendicular to the track plane of the orbit path.

Besides the resulting space saving in the circular loom, the swapping of the track segments can take place along the shortest path and in the least travel time, and the path and the travel time of the warp threads to cross the track plane can be shortened in a straight line with as few deflections as possible, with the result that the track segment swap speed and the changeover speed of the warp threads and hence the circular speed of the shuttles can be further increased.

The positioning part of the guide device can be movably or pivotably/rotatably mounted by means of suitable bearing elements on a base body of the guide device or on a component of the machine housing or directly on the outer circumference of the circular orbit path.

The base body of the guide device in turn can be arranged on a component of the machine housing or directly on the outer circumference of the circular orbit path and there be stationarily or movably mounted.

One or more positioning parts can be assigned to a base body.

If a base body is provided that is arranged in the radial direction between the positioning part and the circular orbit path, then this is preferably designed and in relation to the warp thread carried by the positioning part arranged in such a way as to enable the contactless passage of the guided warp thread through the base body in the direction of the circular orbit path.

For example, the base body can have a slot-like pass-through opening assigned to the thread guide or rather to the path of the thread outlet so that the warp thread, preferably without touching the pass-through opening, can run through it.

The bearing element(s) for the movable or rotatable mounting of a positioning part, e.g. a guide carriage or a guide cylinder, can be for example one or more longitudinally extended or curved guide groove(s) of the base body or of the component of the machine housing or of the positioning part, which are arranged extended in the direction of the intended straight or curved movement axis for swapping the track segments and correspond to suitable guide pins or guide bar(s) of the positioning part or of the base body or of the component of the machine housing.

In particular, corresponding bearing elements in a dovetail form (tongue and groove) may be provided.

Furthermore the bearing element(s) can also be one or more guide rail(s) corresponding with rollers or bearing bushes.

The corresponding bearing elements are preferably designed so that they slide or roll on or against each other with as little frictional resistance as possible so that the positioning part can be moved and accelerated as easily and quickly as possible.

In such cases, it is advantageous if the positioning part also has as low a mass as possible. In this regard, the material for the positioning part is preferably plastic or a light metal.

Several bearing elements such as longitudinally extended guide grooves, guide bars or guide rails can be arranged parallel to each other, which makes the bearing and guidance of the guide carriage and hence the guidance of the track segments and warp threads even more accurate and certain.

The bearing elements for bearing a guide carriage can be designed in accordance with known linear guides, such as linear guides made by Festo.

The mounting of the guided track segments of the orbit path for performing their linear relative movement with respect to each other can take place e.g. by means of flat slide surfaces facing each other.

The precision of the mounting and guidance of the track segments can be increased by a tongue-and-groove connection to the slide surfaces facing each other.

The linear relative movement of the guided track segments with respect to each other can by means of the guide device be implemented relatively simply constructively and in terms of control technology.

Furthermore if the warp thread spool of at least one warp spool device is essentially arranged in a straight and hence deflection-free extension of the running path of the warp thread through the thread guide element and/or essentially in a straight and hence deflection-free extension of the moving or swivelling path of the thread guide element, the design may result in an advantageous reduction of the total required thread deflections in the path of the warp thread between the warp spool device and its passage through the thread outlet of the guide device.

In particular, this allows firstly the thread tension of the warp threads concerned to be kept even more stable with lower thread tension losses, and secondly the thread guidance can be implemented in a way that is particularly gentle on the threads.

In particular as a result of a stable thread tension and gentle guidance of the weft and warp threads, the greatest possible variety of thread, ribbon or fibre materials in various fibre thicknesses and combinations thereof can be used, for example delicate carbon fibres, but also broad flat ribbons or other textile skeins.

An advantageous design of the invention envisages that the warp thread spool of at least one warp spool device is arranged essentially in a lengthening of the radial extent of the circular orbit path.

As a result, in particular the warp thread spool(s) of the warp spool device(s) are arranged not only outside of the circumference of the circular orbit path but also essentially in a radial lengthening of the orbit path or rather of the track plane.

The warp thread spools of several warp spool devices can be arranged in a radial, star-shaped arrangement around the outer circumference of the circular orbit path.

The warp spool device(s) can be fastened e.g. to a radial outer wall of the machine housing of the circular loom.

In this arrangement, the warp threads can run with very little deflection from the warp thread spool via the guide device(s) to the weaving point.

The thread deflections of the warp threads to be performed by the alternating back-and-forth movement of the guide device(s) are largely reduced and at the same time the thread length of the warp thread is subject to fewer fluctuations, which makes a further advantageous contribution to a constant thread tension.

A particularly advantageous design of the invention envisages that at least one warp spool device is arranged on the guide device and/or on a first and/or second track segment.

In this case, the warp spool device(s) are carried directly by the guide device, preferably by the movable positioning part, and/or indirectly by a first and/or second track segment arranged on the guide device.

Preferably the warp spool device can be carried piggy-back-style by the moving guide device and/or held by the guide device or the track segment(s) in a section between the first and second track segment.

Preferably the warp spool device(s) can be arranged and carried on the movable positioning part(s) of the guide device(s).

One or more warp spool devices can be arranged on a guide device, in particular on a positioning part of the guide device, or on a track segment.

With the arrangement of the warp spool device e.g. between a first and second track segment, firstly in a constructively advantageous way the design of a separate thread guide element and a thread outlet for letting the warp thread out of the guide device may be unnecessary and furthermore in a technologically advantageous way the warp thread can be guided directly and without further deflections from the warp thread spool to the weaving point.

In the design of the invention, greater compactness of the circular loom can be achieved and to the advantage of further improved thread tension and thread protection the path of the warp thread can be further shortened and the number of required deflections in the thread guidance of the warp thread can be minimised, particularly since as a result of the direct assignment of the warp spool device to the guide device the thread tension can be kept stable explicitly for the individual warp thread.

With the carrying of several warp spool devices, two or more warp threads of the warp spool devices can be guided together or individually between a track segment pair comprising first and second track segment, with the warp threads together or individually preferably passing through in each case a thread guide element of the guide device or being directly led away from the individual carried warp thread spools.

These combinations enable the joint guiding and weaving of several, even different kinds of warp threads, particularly while ensuring an essentially consistent high thread tension of the warp threads.

According to a constructively favourable design of the invention, the circular orbit path has at least one guide rail or is formed by at least one guide rail, in or on which at least one shuttle is guided.

Corresponding to the arrangement and design of the existing track segments of the orbit path, the guide rail is designed subdivided into ring-segment-shaped rail segments, which are arranged largely flushly one after the other and which form the closed guide rail in a ring shape.

The shuttle or the shuttles can orbit by rolling or sliding means in or on the at least one ring-shaped guide rail, which defines the circular orbit path, where the shuttle or the shuttles move, roll, slide over the nearly gap-free separation points between the individual rail segments of the ring-shaped guide rail.

Accordingly, the nearly gap-free separation points in the ring-shaped guide rail have almost no effect on the passage and hence on the smooth running of the shuttles.

To improve the running accuracy, the shuttle or shuttles can also orbit by rolling or sliding means on several guide rails that are arranged spaced apart.

The alternating positions of the warp threads can preferably be designed to be so close to the axial boundary of the ring-shaped guide rail that the passage of the shuttle without touching is only just ensured.

The guide rail is preferably designed as an internal-runner rail, in which the shuttle(s) orbit within the circular orbit path which radially delimits the track plane.

It is also possible to conceive a design where the shuttle(s) are arranged in an integrated manner within several guide rails that are arranged spaced apart.

The guide rail(s) in all cases provide a track that enables a low-vibration orbit of the shuttles with consistently high thread tension of the weft threads, as a result of which a largely homogeneous weaving operation at a simultaneously high circular speed is achievable.

The shuttle can for example be guided by means of rollers, preferably by means of rubberised rollers, in or on the guide rail and roll over the separation points, which further improves the smooth running of the shuttle in respect of vibrations and roller noise.

According to a further advantageous embodiment of the invention, the guiding and/or the drive of the shuttle on or in the circular orbit path is designed magnetically and/or electromagnetically, e.g. similarly to a known Transrapid propulsion system. In this case, e.g. on the circular orbit path, a wandering electromagnetic field can be generated so that the shuttle by means of a magnetic bearing and/or electromagnetic steering is guided and/or driven rolling, sliding or floating contactlessly along the electromagnetic field and hence along the circular orbit path.

In this way, in particular the frictional resistances in the orbit of the shuttles along the circular orbit path and over the separation points can be further reduced.

According to a particularly advantageous embodiment of the invention, a second circular orbit path is provided, along which in each case at least one shuttle is movable, where the second circular orbit path is formed of second track segments arranged one after the other along its circumference, where the guide device guides a further warp thread provided from a warp thread spool of a warp spool device and on which (in addition to at least one first track segment of the first orbit path and a second track segment of the second orbit path) at least one third track segment alternatively assignable to the second orbit path is arranged and guided, where in the guided absence of the second and third track segment from the second orbit path the additional guided warp thread, crossing the second track plane, passes through the second orbit path.

Whereas the track segments of the first orbit path are referred to as first track segments, the track segments of the second orbit path are referred to as second track segments, where the second track segments according to the definition in the claim described above at the same time are the track segments alternatively assignable to the first orbit path.

Furthermore, the substitute track segments assigned to the second track segments, preferably in the same number, are referred to as third track segments.

The radially outer circumference of the first circular orbit path forms the radial boundary of the first track plane of the circular loom and the radially outer circumference of the second circular orbit path forms the radial boundary of the second track plane of the circular loom, within which in each case the orbit of at least one shuttle is effected.

Preferably at least one first track segment of the first orbit path as well as at least one second track segment of the second orbit path and furthermore at least one third track segment are arranged on a movable guide device as a track segment trio and together with at least two warp threads guided between the three track segments form a guided unit.

The third track segment arranged on the guide device in assignment to a second track segment of the second orbit path is designed in interaction with the alternatingly moving guide device as a temporarily acting substitute track segment for the second track segment of the second circular orbit path.

At the same time, the second track segment of the second orbit path, which track segment is arranged on the guide device in assignment to a first track segment of the first orbit path, can act in interaction with the alternatingly movable guide device as a temporary substitute track segment for the first track segment of the first orbit path.

The warp threads provided from the warp spool devices and carried with the guide device can cross the two track planes of the first and/or second orbit path, which are briefly opened as a result of the temporary swapping of the track segments, and hence change sides of the orbit paths, while the first and second orbit path is closed alternatively e.g. by the second and third track segment respectively, in order in this change position of the warp threads to ensure the passage of the shuttles on the closed orbit paths.

By means of the guide device assigned to the two orbit paths, the guided warp threads can be moved, crossing the respective track planes alternatingly and following any sequence pattern.

In particular, with the alternating movement of the guide device in addition to the position change of a first warp thread carried by the guide device, a first track segment of the first orbit path can be briefly swapped out and replaced by a second track segment of the second orbit path and at the same time in addition to the position change of a second warp thread a second track segment of the second orbit path can be briefly swapped out and replaced by a third track segment and vice versa.

During the phase of swapping the track segments, a displacement of the track segments concerned out of the track plane of their respective orbit path takes place, where temporarily in each case a discontinuity in the respective orbit path arises, which both the warp thread carried between the first track segment and the second track segment and the warp thread carried between the second track segment and the third track segment can use to cross the orbit path or rather the track plane, and thus change the side of the orbit path, while subsequently the shuttles can pass unimpeded through e.g. the first orbit path alternatively closed by the second track segment and the second orbit path alternatively closed by the third track segment.

Each guide device can be moved relative to an adjacently arranged guide device, as a result of which also the guided units of the two orbit paths can be moved relative to each other.

Analogously to the design with one orbit path, here too in each case a guide device can be provided for carrying in each case one track segment trio and guiding two warp threads or in each case one guide device can be provided for carrying several track segment trios and/or more than two warp threads.

As a result of combining the circular orbit paths with each other, parallel operation of several shuttles with different circulation directions and circulation cycles as well as various thread, ribbon or fibre materials is possible, as a result of which a large number of different weft threads and warp threads can be processed simultaneously and an even greater variety of possible weave patterns and fabric characteristics can be created.

These and further features arising from the patent claims, the description of the example embodiments and the drawings can in each case be realised by themselves or in combination as advantageous embodiments of the invention for which protection is claimed here.

BRIEF DESCRIPTION OF THE DRAWINGS

The circular loom according to the invention is explained in greater detail below with several example embodiments. The associated drawings show in a schematic representation in FIG. 1 a front view of a circular loom according to the invention for weaving a contoured, two-part weaving core with a variable core cross-section, with a rail-guided circular orbit path for two shuttles and with 12 stationary warp spool devices and 12 guide devices, FIGS. 2*a,b* side views of the circular loom according to FIG. 1 (from the right) in two operating phases of weaving the contoured, two-part weaving core with variable core cross-section, FIG. 3 a front view of a second design of the circular loom according to the invention for weaving a cylindrical weaving core, with a rail-guided circular orbit path for two shuttles and with 12 stationary warp spool devices and 12 guide devices, FIG. 4 a half-sided side view of the circular loom according to FIG. 3, FIG. 5 a half-sided side view of the circular loom according to FIG. 3, however with 24 stationary warp spool devices and 12 guide devices, FIG. 6 a front view of a third design of the circular loom according to the invention for weaving a cylindrical weaving core, with a rail-guided circular orbit path for two shuttles and with 12 warp spool devices on 12 guide devices, FIGS. 7*a,b* side views of the circular loom according to FIG. 6 in two operating phases of weaving the cylindrical weaving core, FIG. 8 half-sided side view of the circular loom according to FIG. 6, however with 24 warp spool devices on 12 guide devices, FIG. 9 half-sided side view of a fourth design of the circular loom according to the invention for weaving a cylindrical weaving core, with a rail-guided circular orbit path for two shuttles and with 12 warp spool devices between in each case a first and second track segment, FIGS. 10*a,b* side views of a fifth design of the circular loom according to the invention, similar to the circular loom according to FIG. 6 with two rail-guided circular orbit paths for in each case two shuttles and with 24 warp spool devices on 12 guide devices in three working phases of weaving a cylindrical weaving core.

DETAILED DESCRIPTION OF EXEMPLARY EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

In the examples explained below, reference is made to the accompanying drawings, which form part of the examples and in which specific embodiments in which the invention can be put into practice are shown for illustrative purposes.

Identical, equivalent or similarly designed elements are assigned identical reference symbols where appropriate.

It is to be understood that other embodiments can be used and structural or logical changes made without departing from the protective scope of the present invention.

It is to be understood that the characteristics of the various designs described herein can be combined with each other unless specified to the contrary. The following detailed description should therefore not be understood in a restrictive sense.

The scope of protection of the present invention is defined by the attached claims.

Figure 1:
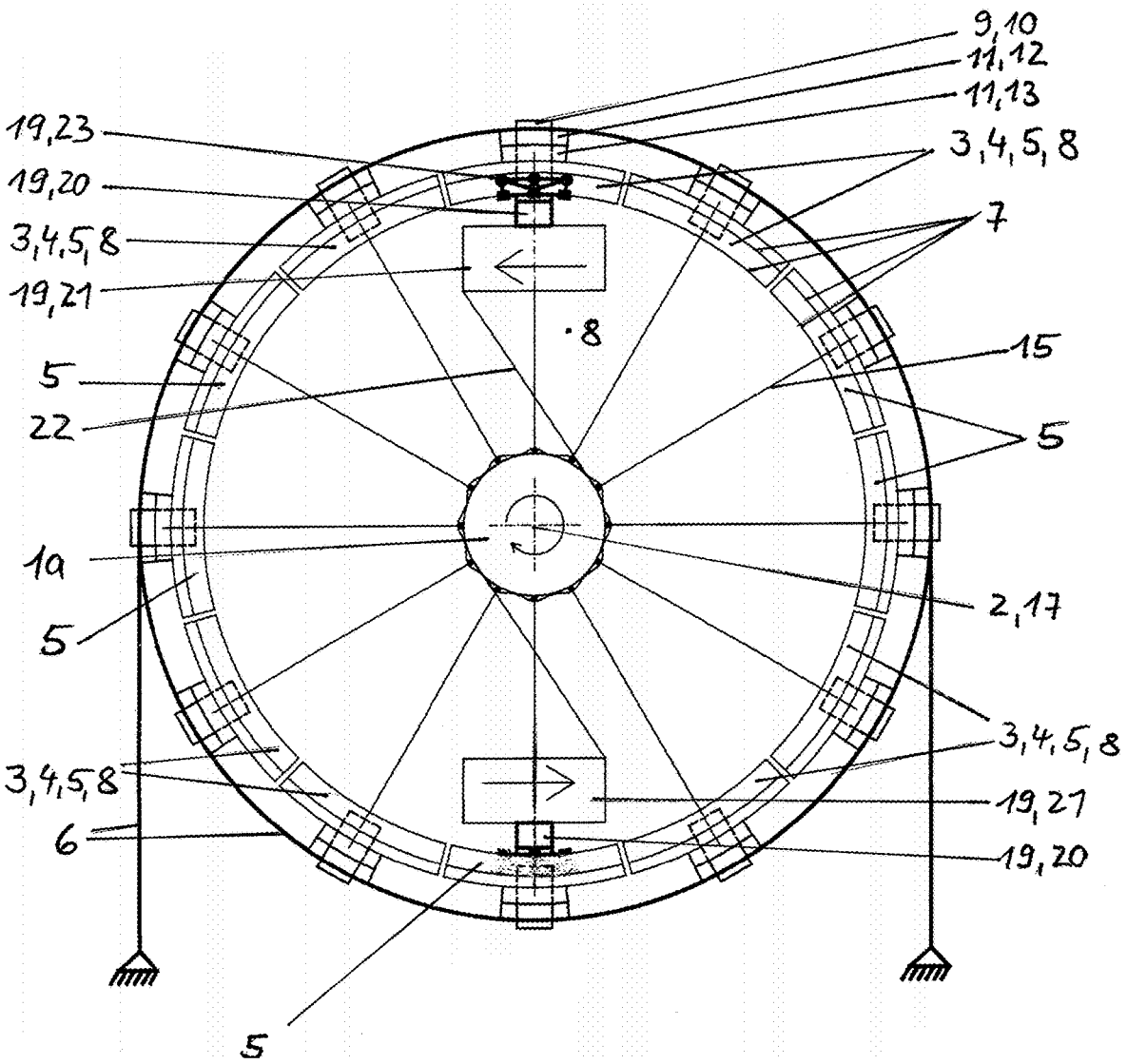

FIG. 1 shows a circular loom, in which a weaving core 1*a* is arranged centrically to a weaving axis 2 of the circular loom and is surrounded by a circular orbit path 3 of the circular loom. The orbit path 3 has a ring-shaped, segmented track body 4 comprising 12 track segments 5 designed in a ring segment shape, which are arranged nearly gap-free very closely one after the other. Each track segment has in each case three rail pairs of guide rails 7 running in a ring segment shape, where the rail segment pairs (rail pairs) 7 of the track segments 5 arranged one after the other are arranged concentrically around the central weaving axis 2 of the circular loom and nearly flushly abutting one other, and thus are designed to form in combination a continuous circle.

Figure 2A:
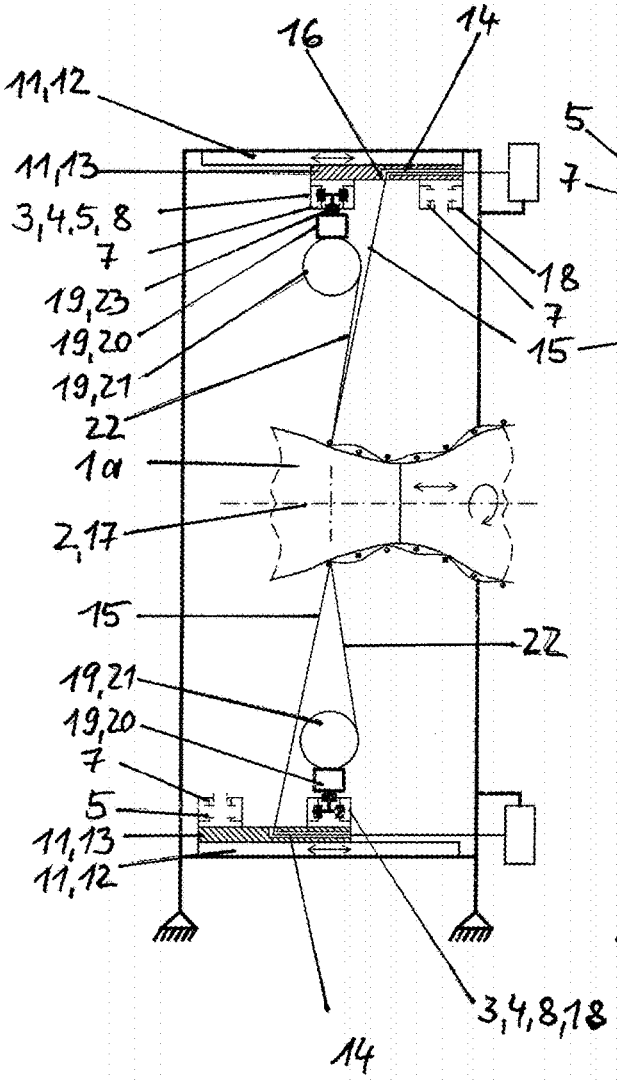

Two outer rail pairs with in each case two guide rails 7 are in each case arranged on the opposite radially extended side walls of the track segments 5 and an inner rail pair, with in each case two guide rails 7 is in each case arranged on an axially extended inner wall of the track segments 5 facing towards the weaving axis 2 (see also FIG. 2*a, b*).

The radially outer boundary of the track body 4 is formed by the axially extended outer walls of the track segments 5 facing away from the weaving axis 2, while the radially extended side walls of the track segments 5 axially delimit the track body 4.

The segmented track body 4 together with the segmented guide rails 7 (rail segment pairs) forms the circular orbit path 3, where the outer boundary of the track body 4 in its radial and axial extension defines the outer contour of a track plane 8 of the circular orbit path 3.

The circular loom further has 12 warp spool devices 9 each with 12 warp thread spools 10, which are arranged fixed relative to the housing laterally on a preferably hollow cylindrical machine housing 6 of the circular loom (see also FIG. 2*a,b*).

Corresponding to the number of available warp spool devices 9 and track segments 5 of the orbit path, on the outer circumference of the track body 4 a total of 12 mobile guide devices 11 are arranged outside the circular orbit path 3 and concentrically around the central weaving axis 2 of the circular loom.

Each of the guide devices 11 has a base body 12 that is fixed to the machine housing 6 and a positioning part 13 that is axially movable relative to the base body 12 and the machine housing 6, which in the example embodiment is designed as a guide carriage 13.

On each of the axially movable guide carriages, among other things one of the 12 track segments 5 of the orbit path 3 is arranged.

The guide carriage 13 contains a thread guide element 14 for guiding and steering a warp thread 15, which in this example embodiment is designed as a thread guide channel 14 (thread channel) directed axially in the direction of the weaving axis 2 and ends with a thread deflector in a thread outlet 16.

The weaving core 1*a* has a weaving core axis 17 which according to the arrangement in this example embodiment runs congruently with the weaving axis 2 of the circular loom. As can be clearly seen from the side view according to FIG. 2*a, b*, the separable weaving core 1*a* is designed with a variable core cross-section and hence with a non-uniform circumference. It is mounted rotatably around its weaving core axis 17 and movably along the weaving axis 2 of the circular loom.

FIGS. 1, 2*a* and *b* show that the warp threads 15 from the warp spools 10 provided by the warp spool devices 9 while maintaining a certain thread tension of a not shown thread tensioner of the warp spool device 9 for weaving the weaving core 1*a* are in each case guided by means of an axially directed thread channel 14 of the axially movable guide carriage 13 of the guide device 11, as a result of which the warp threads 15 run essentially perpendicular to the track plane 8 through the thread channel 14 and are guided with the thread channel 14. The warp threads 15 emerge from a thread outlet 16 of the guide carriage 13, from where they are guided linearly to in each case to a weaving point on the weaving core 1*a*.

Corresponding to the number of the 12 track segments 5 of the orbit path 3, on the guide carriage 13 are arranged furthermore in each case identically designed second track segments 18, which have a matching guide rail 7 with in each case three rail segment pairs 7, all of which are parallel to the track segments 5 of the orbit path 3 and their rail segment pairs 7 and are equally axially spaced.

The track segments 5 of the orbit path 3 are furthermore referred to as first track segments 5 and the track segments 18 axially adjacent to the first track segments 5 of the orbit path 3 are furthermore referred to as second track segments 18.

In each case a first track segment 5 of the orbit path 3 and an adjacent, second track segment 18 are arranged in pairs on a guide carriage 13 and carried with it.

The thread outlet 16 of the guided warp thread 15 of the respective guide carriage 13 is in each case arranged at a middle distance between the track segment pair 5, 18 comprising the first track segment 5 and the second track segment 18.

Along the segmented guide rails 7 of the orbit path 3, two shuttles 19 are guided, each of which has a shuttle carriage 20 with in each case a weft thread spool 21.

The weft thread 22 of the weft thread spool 21 is guided to weave the non-uniformly contoured weaving core 1*a* while maintaining a certain thread tension linearly to the current weaving point on the weaving core 1*a*.

The shuttles 19 run by means of the shuttle carriages 20 along the guide rails 7, which form the guide for the orbiting shuttles 19 and thus determine the circular movement path of the shuttles 19.

The rotary axis of the weft thread spool 21 is arranged in the orbit direction of the shuttle 19 so that the feeding of the weft threads 22 to the weaving core 1*a* is achieved largely with few deflections or without deflections.

The shuttle carriages 20 each have nine rubberised guide rollers 23, of which in each case three guide rollers 23 are assigned to a rail pair of the guide rails 7. In each case three guide rollers 23 are held and guided on both sides by the two outer rail pairs of the guide rails 7 and three additional rollers 23 are guided on both sides by the inner rail pair of the guide rails 7.

Each shuttle 19 can be driven and controlled separately by means of a motor (direct drive) located on the shuttle carriage 20, where the power supply can be provided e.g. via several sliding contacts or onboard energy stores, and the control commands can be transmitted e.g. via radio control signals (not shown).

The shuttles 19 can therefore roll independently of each other at the same or different speeds along the guide rails 7 of the orbit path 3.

The guide rollers 23 are designed in such a large number and spaced so far apart from each other that the shuttle carriage 20 during its orbit always makes contact with at least two track segments 5 and hence can bridge one or even several separation points of the segmented track body 4 at the same time, ensuring smooth and quiet running of the shuttle carriages 20.

In FIGS. 1, 2*a, b* both orbiting shuttle carriages 20 of the shuttles 19 are shown schematically in the 6 o'clock and 12 o'clock position along the orbit path 3 respectively.

For the sake of clarity, FIGS. 2*a, b* in each case show only the two warp spool devices 9 and the associated guide devices 11, each with one track segment pair 5, 18 comprising a first and second track segment, in the 6 o'clock and 12 o'clock position of the circular loom.

The guide carriages 13 arranged around the circumference of the orbit path 3 are in each case mounted linearly slidably relative to each other in the axial direction parallel to the weaving axis 3.

To mount the guide carriage 13, on the base body 12 two longitudinally extended guide grooves arranged parallel to each other are provided, in which the guide carriage 13 is slidably mounted and guided with two corresponding guide bars (not shown).

The guide grooves and guide bars are aligned axially in the direction of the weaving axis 2, with the result that the guide carriages 13 with the thread channel 14 and the carried warp threads 15 in each case can be moved essentially perpendicularly to the track plane 8 of the orbit path 3 and parallel to the weaving axis 2.

The movement of the guide carriage results in the carrying and axially directed relative movement of the track segment pair 5, 18 comprising a first track segment and second track segment with respect to the in each case in the circumference of the orbit path 3 adjacently arranged track segment pair 5, 18 comprising a first and second track segment of the adjacent guide carriage 13.

For guiding the track segment pairs 5, 18 the relevant adjacent track segments 5, 18 have slide surfaces on their end faces facing each other in the circumferential direction, along which they slide during their relative movement with respect to each other (not shown).

The precision of the axial guidance of the track segments 5 and 18 is increased by means of corresponding guide grooves and guide bars (not shown) provided on the end faces facing each other.

The fast alternating movement of the guide carriages 13 is generated and controlled via individual, switchable electric linear drives, acting in two directions (not shown).

Control of the back-and-forth movement of the guide carriage 13 can be realised along a rack or threaded rod (not shown).

In this example embodiment, the warp thread spools 10 of the warp spool devices 9 are in each case arranged in a straight-line extension of the thread channel 14 of the guide carriage 13 on the machine housing 6.

The feeding of the warp threads 15 from the warp thread spools 10 via the thread channel 14 of the guide carriage 13 on to the weaving point on weaving core 1*a* thus largely takes place in a straight line with few deflections, whereby the thread tension of the warp threads 15 can be maintained at a high level.

For the alternating changeover of the track segments 5, 18 and of the warp thread 15 of a guide device 11, these are in each case guided linearly back and forth in the axial direction by means of the movable guide carriage 13, as a result of which a first track segment 5 of the orbit path is replaced by a second track segment 18 and vice versa, and the warp thread 15 emerging from the thread outlet 16 is brought to both sides of the track plane 8 of the orbit path 3 (see FIGS. 2*a, b*).

During the swapping of the track segments 5, 18 the warp thread 15 passes through the briefly missing track segments 5 and 18 temporarily forming discontinuity the orbit path 3 and can therefore for the purpose of changing sides be conveyed through the track plane 8, or rather through the temporarily opened orbit path 3 in both directions without touching.

The warp threads 15 running to the weaving point, as they are alternatingly guided back and forth, assume a changing angle (weaving angle) with respect to the extension of the track plane 8. When passing through the orbit path 3, the weaving angle of the warp threads 15 is approximately 0°, and in the change position to ensure the passage of the shuttle 19, the maximum weaving angle of the warp threads 15 is reached (see FIGS. 2*a, b*).

Since during the necessary change of sides of the warp threads 15, apart from the warp threads 15 themselves there are no components of the guide device 11 or of the orbit path 3 in the area of the orbit path 3 or within the track plane 8, the respective temporarily generated discontinuity in the interrupted orbit path 3 is formed as an empty space (void), through which the respective warp thread 15 can be passed unimpeded. Furthermore, this results in there being no components of the guide device 11 between the track segments 5, 18 with the result that the shuttles 19 alone determine the outer axial boundary for the axial positioning of the warp threads 15 during the passage of the shuttles 19, with the result that the warp threads 15 can form an optimally small maximum weaving angle, which results during the position change of the warp threads 15 in a small angle change of the weaving angle of the warp threads 15 relative to the track plane 8.

This angle limitation of the movement of the warp threads 15 for the change of sides additionally ensures the maintenance of a high thread tension of the warp threads 15.

The straight-line guiding of the guide carriages 13 of the guide device 11 perpendicularly to the track plane 8 also enables very short paths for conveying the warp threads 15 and consequently in conjunction with the above-mentioned rapidly acting linear drives of the guide carriages 13 it enables a particularly effective alternating of the warp threads 15 on both sides of the track plane 8.

FIGS. 2*a, b* show two operating phases of the weaving process in the circular loom with alternating positioning of the guide carriages 11 with the respective track segments 5, 18 and warp threads 15 while the two shuttles travel around their orbit 19 in each case by 180°.

In the operating phase according to FIG. 2*a*, the two orbiting shuttles 19 are in the 6 o'clock and 12 o'clock position of the circular loom, while some of the guide carriages 13, including the guide carriage 13 of the guide device 11 arranged in the 12 o'clock position, with the warp thread 15 and the second track segment 18 are located in the image plane to the right of the orbit path 3 and other guide carriages 13, including the guide carriage 13 of the guide device 11 arranged in the 6 o'clock position, with the warp thread 15 and the first track segment 5 are located in the image plane to the left of the orbit path 3, with the result that the space for the passage of the shuttles 19 at the 6 o'clock and 12 o'clock position is cleared by the warp threads 15 which are spread out away from the track plane 8 forming a shed.

If the guide carriage 13 of the guide device 11 is positioned in the image plane to the right of the orbit path 3, then the orbit path 3 is simultaneously circumferentially closed by the first track segment 5, while the adjacent second track segment 18 is located in the stand-by position to the right of the orbit path 3. If the guide carriage 13 of the guide device 11 is positioned in the image plane to the left of the orbit path 3, then the orbit path 3 is alternatively circumferentially closed by the adjacent second track segment 18, while the first track segment 5 is located in the standby position to the left of the orbit path 3.

An arbitrary number of guide carriages 13, for example every second, third or all guide carriages 13 of the guide devices 11 can be located in the image plane to the right or left of the orbit path 3 during an orbit of the shuttle 19.

Figure 2B:
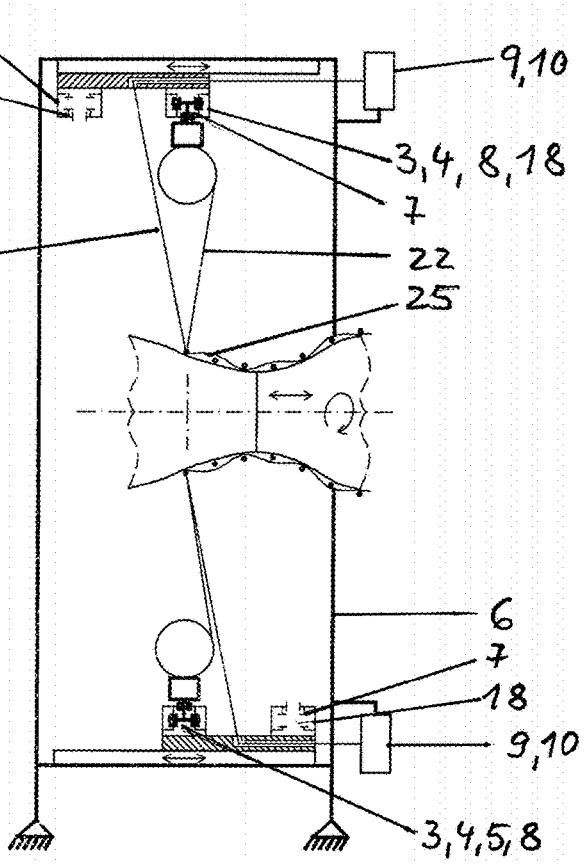

FIG. 2*b* shows the operating phase of the circular loom in which the shuttle 19 that was previously in the 6 o'clock position is passing the 12 o'clock position and vice versa, while some guide carriages 13, including the guide carriage 13 of the guide device 11 arranged in the 12 o'clock position, with the warp thread 15 and the first track segment 5 are located in the image plane to the left of the orbit path 3, and other guide carriages 13, including the guide carriage 13 of the guide device 11 arranged in the 6 o'clock position, with the warp thread 15 and the second track segment 18 are located in the image plane to the right of the orbit path 3, while the shuttles 19 pass through the 6 o'clock and 12 o'clock position.

However, here too an arbitrary number of guide carriages 13, for example every second, third or all guide carriages 13 of the 12 guide devices 11 can be located in the image plane to the right or left of the orbit path 3.

Corresponding to the position of the guide carriages 13 of the guide device 11 in the image plane to the right or left of the orbit path 3, the orbit path 3 is immediately circumferentially closed by means of in each case the first track segment 5 or alternatively the second track segment 18 before the shuttles 19 travel through the orbit path 3.

Furthermore, the shuttles 19 may circulate at symmetrical or asymmetrical intervals from each other on the guide rails 7.

The warp threads 15 are spread out alternately in opposite directions in the above-described mode or in another alternating mode of the guide carriages 13, the result of which is to produce an undulation of the warp threads 15 with the weft threads 22 of the shuttles 19 orbiting in a particular mode on the orbit path 3, to generate a hollow-profile-like fabric 25 with the desired weave pattern, as shown in FIGS. 2*a, b*.

During the weaving process, the non-uniformly profiled weaving core 1*a* can be axially moved along the weaving axis 2, with the fabric 25 being set down in a fixed/stationary manner on the weaving core 1*a*. Depending on the desired weaving result, the axial movement of the weaving core 1*a* can take place for example quasi-stationarily, discontinuously, or continuously.

A forwards and backwards movement of the weaving core 1*a* to generate several fabric layers 25 is also possible.

During its axial movement, the weaving core 1*a* can additionally be moved in rotation around its weaving core axis 17 or be tilted relative to the weaving axis 2 in order to generate a changed angular position of the warp threads 15 and the weft threads 22 of e.g. +/−60° to the weaving core axis 17 on the weaving core 1*a*.

The uniform weaving structure shown in FIGS. 2*a, b* resulting from a uniform weaving mode can be changed by means of the individual drive and the controlling of both the shuttle carriages 20 and the guide carriages 13 as well as the weaving core 1*a*, also during the weaving process.

The shuttle carriages 20 can, by means of the guide carriages 13, orbit very precisely and evenly and consequently at a high running speed on precisely positionable track segments 5, 18 with the guide rails 7 that nearly flushly abut one another, and at the same time apply a high thread tension to the carried weft thread 22.

The fast, alternating spreading of the warp threads 15 by means of the guide carriages 13 that are operable over short distances furthermore enables the running speed of the shuttles 19 orbiting on the guide rails 7 to be increased.

Once the weaving core 1*a* has been woven it can be removed sideways out of the circular loom and another weaving core to be woven can be fitted into the circular loom.

The stated advantages of the circular loom result in high process efficiency and also enable the weaving of the weaving core 1*a* with a very tightly and firmly woven fabric 25.

For this reason, the circular loom is particularly suitable also for weaving large, non-uniformly contoured weaving cores with contour-conforming technical fabrics, e.g. for manufacturing woven hollow-profile fibre preforms for wheel rims.

Figure 3:
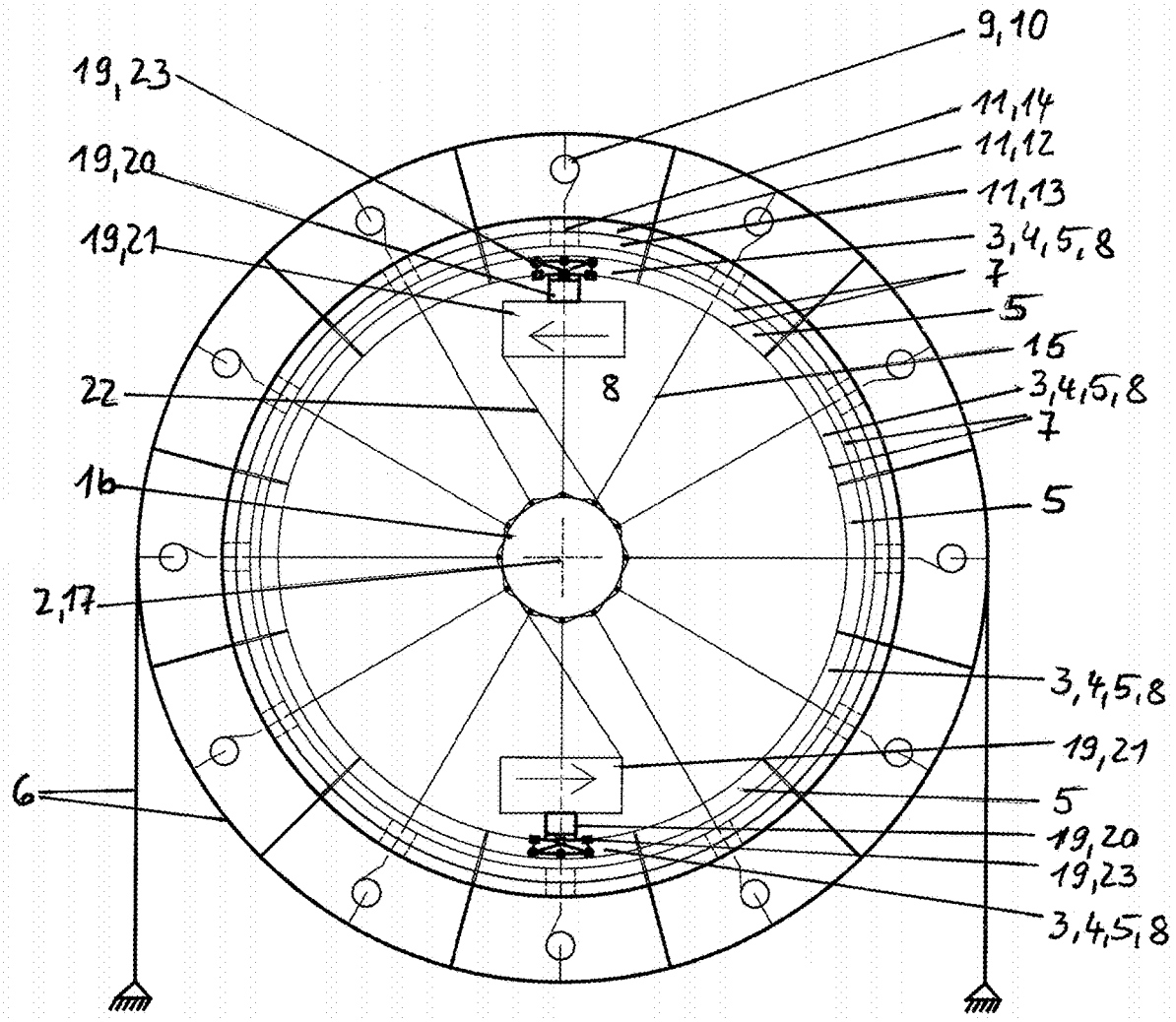
Figure 5:
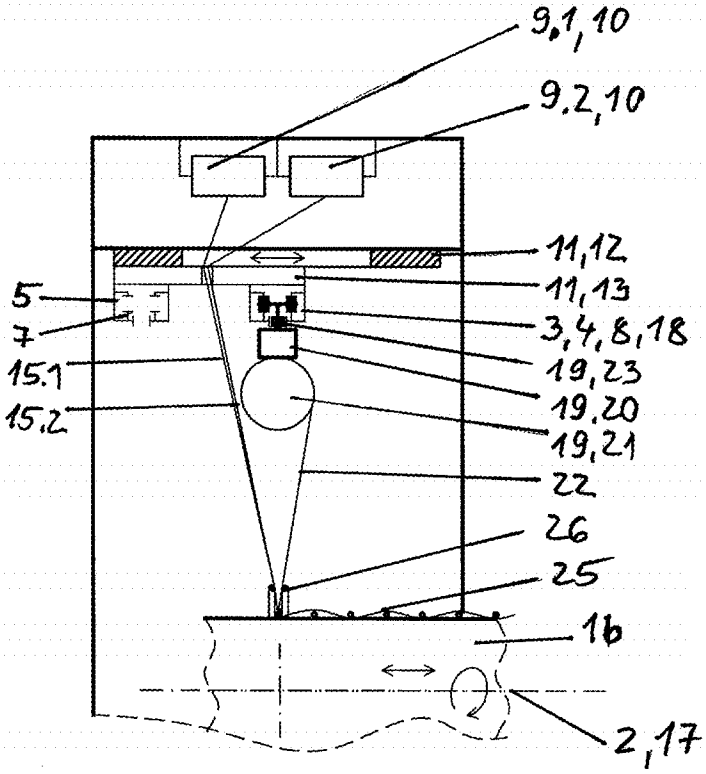
Figure 4:
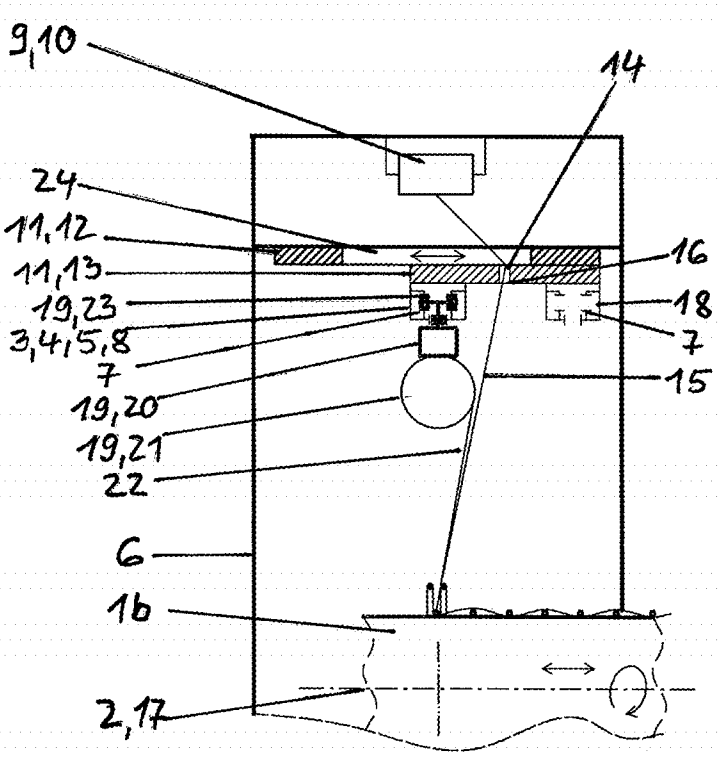

FIGS. 3, 4, 5 show a second design of the circular loom according to the invention, in this case for weaving a cylindrical weaving core 1*b*.

The above description for the first design of the circular loom also applies in respect of the matching features and their advantages to the circular loom described here according to the second design, with the result that in this regard reference is made to the corresponding statements.

To avoid repetition, only the differences compared to the first design of the circular loom according to FIGS. 1, 2*a, b* are described below.

In this design, the warp spool devices 9 are arranged fixed relative to the housing essentially in a lengthening of the radial extent of the circular orbit path 3 on an outer wall of the machine housing 6 of the circular loom.

The 12 warp spool devices 9 provided according to FIGS. 3 and 4 are arranged essentially centrally in an extension of the track plane 8 of the orbit path 3.

The 24 warp spool devices 9 provided according to FIG. 5 are arranged in pairs next to each other in the axial direction, with the mirror line of a pair of the warp spool devices 9 being arranged essentially centrally in an extension of the track plane 8.

The 12 warp spool devices 9 according to FIGS. 3 and 4 are in each case assigned to a mobile guide device 11 with the result that one warp thread 15 is guided per guide device 11.

The 24 warp spool devices 9 according to FIG. 5 are in each case assigned in pairs to a mobile guide device 11 with the result that two warp threads 15 are guided per guide device 11.

For the sake of clarity, in FIGS. 4 and 5 in each case only the warp spool devices 9 and the associated guide devices 11 arranged in the 12 o'clock position of the circular loom, each with one track segment pair comprising a first and second track segment, are shown and further described.

The base body 12 fixed to the machine housing 6 of the guide device 11 has an axially extended passage 24 for the warp thread to pass through.

The guide carriage 13 of the guide device 11 according to FIGS. 4 and 5 has in each case a thread guide element 14 with a radially directed thread channel 14, followed by the thread outlet 16.

The warp threads 15 provided by the warp spool device 9 according to FIG. 4 run individually through the axially extended passage 24 of the base body 12 and through the radially directed thread channel 14 of a guide carriage 13, whereas the warp threads 15 provided by the warp spool device 9 according to FIG. 5 run in pairs through the axially extended passage 24 of the base body 12 and a radially directed thread channel 15 of each guide carriage 13.

During the alternating sideways movement of the guide carriage 13 to change the positions of the track segments 5, 18 and the warp threads 15, the radially directed thread channel 14 with the warp thread 15 according to FIG. 4 or the thread channel 14 with both warp threads 15 according to FIG. 5 is located alternately in a position to the right and left of the orbit path 3 and track plane 8.

During the sideways motion, momentary intermediate positions of the thread channel 14 occur, e.g. a central position, in which the radially directed thread channel 14 is located essentially in a straight-line extension to the fixed arrangement relative to the housing of the warp thread spool 10 of the warp spool device 9 and therefore temporarily enables a deflection-free path of the warp thread 15 through the thread channel 14.

With this specific guiding of the warp thread 15 (according to FIG. 4)/warp threads 15 (according to FIG. 5), the necessary thread deflections and absolute thread length of the warp threads 15 are reduced and in particular also the different relative thread lengths that result during the sideways movement of the guide carriages 14 are minimised, which further improves the maintenance of the thread tension of the warp threads 15.

With the circular loom design according to FIGS. 3 to 5, by way of example the weaving of a weaving core 1*b* with a uniform, cylindrical core cross-section is intended.

When weaving the cylindrical weaving core 1*b* this can for example be stationarily fixed during the weaving process, with the fabric 25 being continuously pulled off the weaving core in an axial direction along the weaving axis 2 of the circular loom or rather along the weaving core axis 17 of the weaving core 1*b*. Preferably the weaving core 1*b* in this case is aligned with the weaving axis 2 in a congruent axial position.

In the views according to FIGS. 4 and 5 furthermore by way of example a weaving ring 26 fixed relative to the housing is arranged concentrically spaced around the weaving core 1*b*, which additionally homogenises the feeding of the warp threads 15 and weft threads 22 to the weaving point, by damping their thread vibrations and compensating for their thread tension fluctuations, which has an advantageous effect in particular on circular looms having an orbit path 3 of larger diameter and which therefore have larger distances from the weft thread spool 21 and the thread outlets 16 of the thread guide elements 14 of the guide devices 11 to the weaving core 1*b*.

Figure 6:
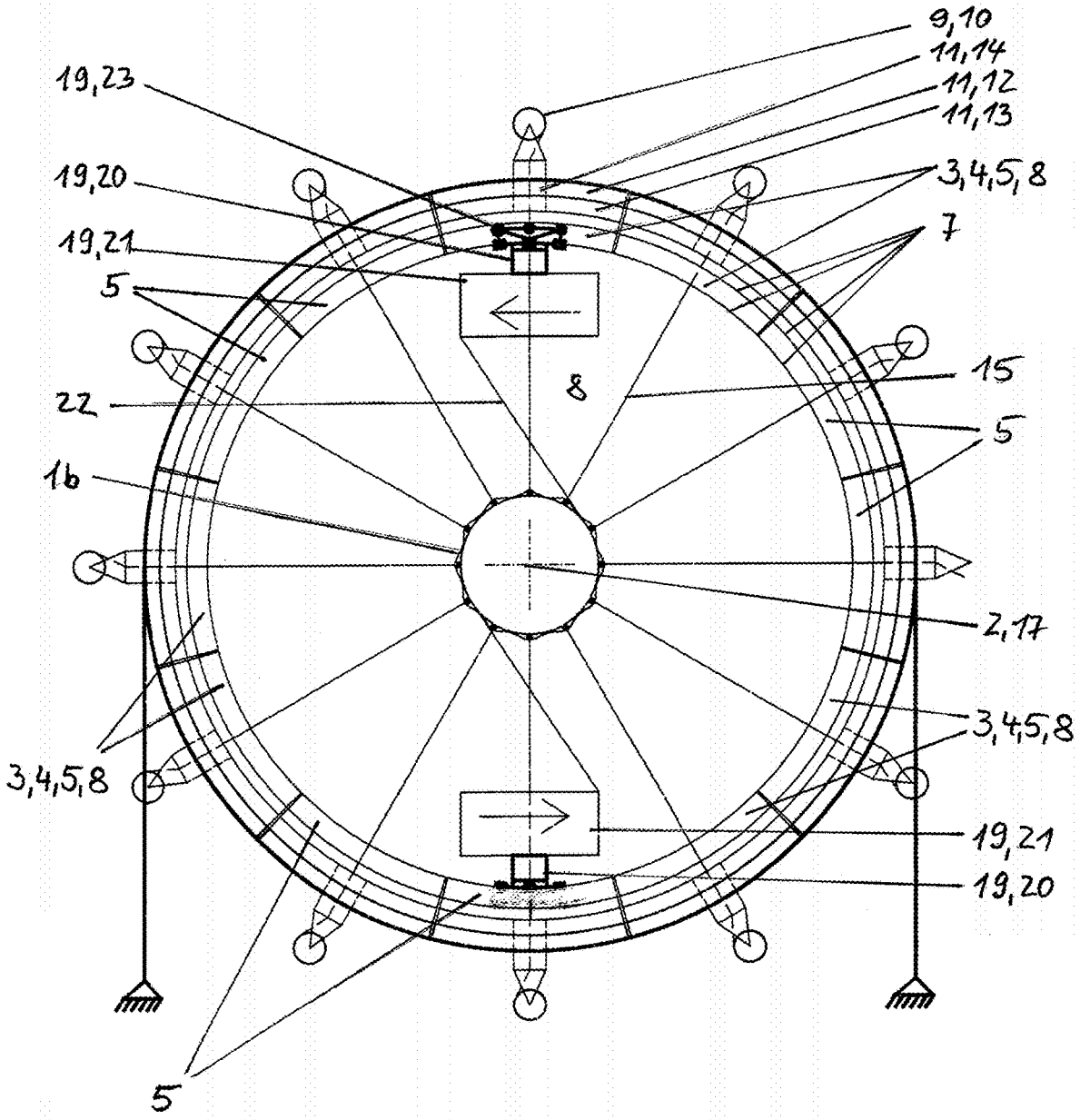
Figure 7A:
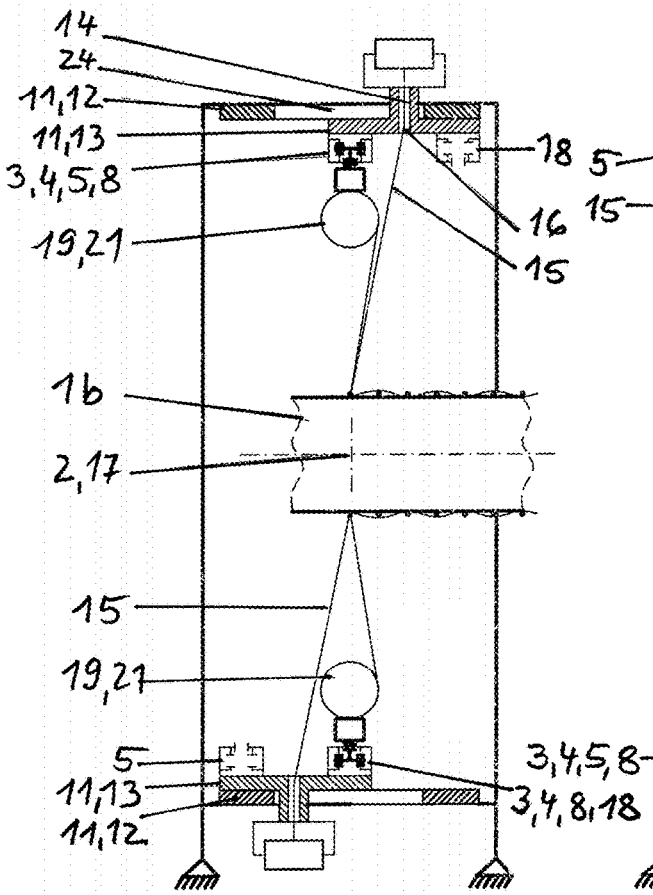

FIGS. 6, 7*a, b* show a third design of the circular loom according to the invention for weaving a cylindrical weaving core 1*b*.

The above description for the second design of the circular loom also applies in respect of the matching features and their advantages to the circular loom described here according to the third design, with the result that in this regard reference is made to the corresponding statements.

To avoid repetition, only the differences compared to the second version of the circular loom according to FIGS. 3 to 5 are described.

In this design, the 12 warp spool devices 9 are arranged in each case on one guide carriage 13 of the 12 guide devices 11 and are carried piggyback-style with the guide carriage. The guide carriage 11, for carrying the warp spool device 9 has a radially extended shaft which rises up from the axially extended passage 24 through the base body 12 of the guide device 11. The radially directed, also longitudinally extended thread channel 14 is designed integrated into the longitudinally extended shaft.

The warp spool device 9 is arranged on the guide carriage 13 in such a manner that the warp thread spool 10 is located essentially in a straight-line extension to the radially directed thread channel 14 and hence always enables a deflection-free path of the warp thread 15 through the thread channel 14.

FIGS. 7*a, b* show two operating phases of the weaving process in the circular loom with alternating positioning of the guide carriages 13 with the warp spool devices 9 while both shuttles 19 travel around their orbit in each case by 180°.

In the operating phase according to FIG. 7*a*, the two orbiting shuttles 19 are in the 6 o'clock and 12 o'clock position of the circular loom, while at the same time, forming a warp thread shed, among other things the guide carriage 13 of the guide device 11 arranged in the 12 o'clock position with the warp spool device 9, the warp thread 15 and the second track segment 18 (in standby position) are located in the image plane to the right of the orbit path 3 and among other things the guide carriage 13 of the guide device 11 arranged in the 6 o'clock position with the warp spool device 9, the warp thread 15 and the first track segment 5 (in standby position) are located in the image plane to the left of the orbit path 3, while the shuttles 19 pass through the 6 o'clock and 12 o'clock position.

Figure 7B:
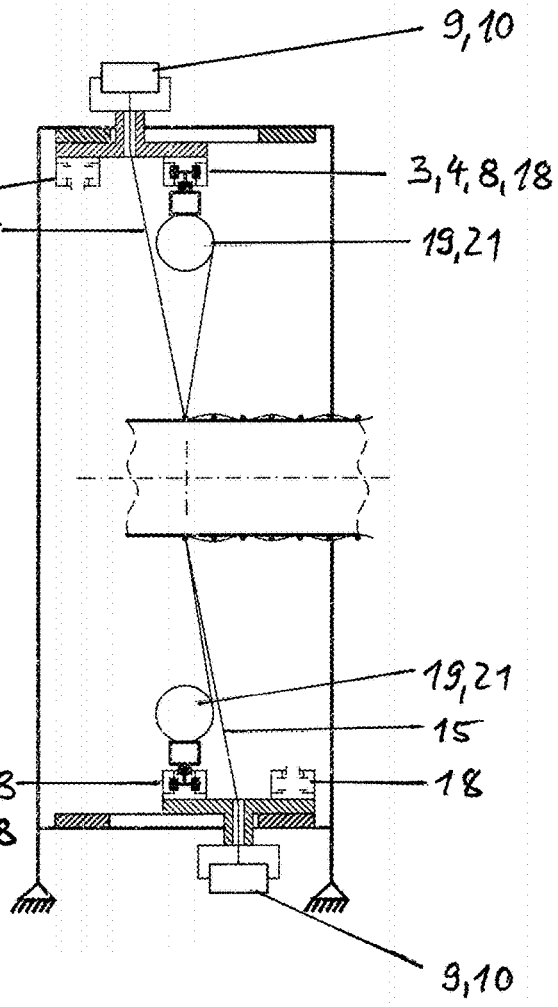

FIG. 7*b* shows the operating phase of the circular loom in which the shuttle 19 that was previously in the 6 o'clock position is passing the 12 o'clock position and vice versa, while now among other things the guide carriage 13 of the guide device 11 arranged in the 12 o'clock position, with the warp spool device 9, the warp thread 15 and the first track segment 5 (in standby position) are located in the image plane to the left of the orbit path 3, and among other things the guide carriage 13 of the guide device 11 arranged in the 6 o'clock position, with the warp spool device 9, the warp thread 15 and the second track segment 18 are located in the image plane to the right of the orbit path 3, while the shuttles 19 pass through the 6 o'clock and 12 o'clock position.

Figure 8:
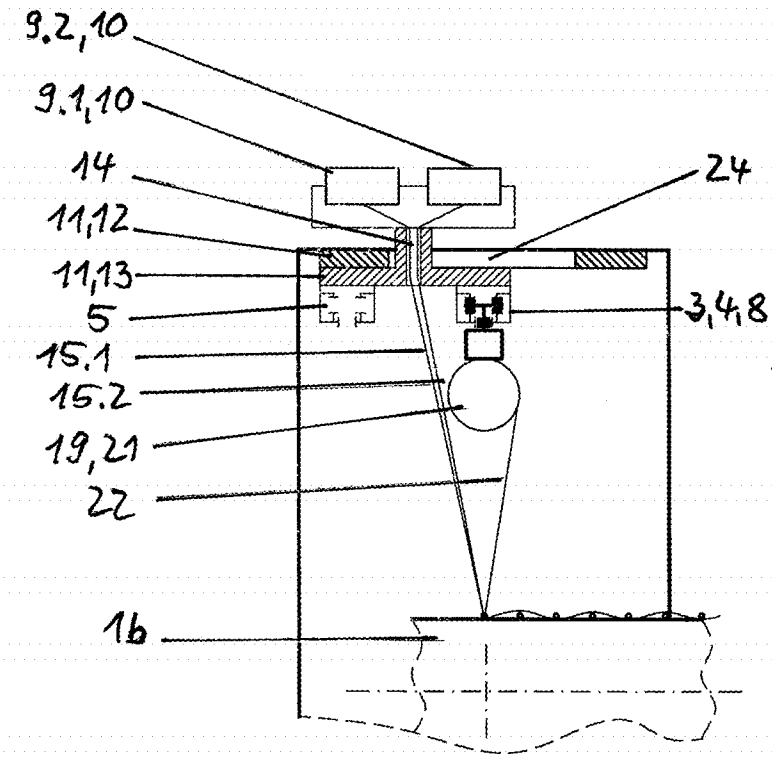

FIG. 8 shows the circular loom according to FIGS. 6 to 7, but with 24 warp spool devices 9, which here are arranged in pairs on the 12 guide devices 11, in particular on the respective guide carriage 13 with radially extended shaft and are carried with it.

Therefore per guide device 11 two warp spool devices 9.1, 9.2 with two warp threads 15.1, 15.2 are guided through the radially directed thread channel 14.

Figure 9:
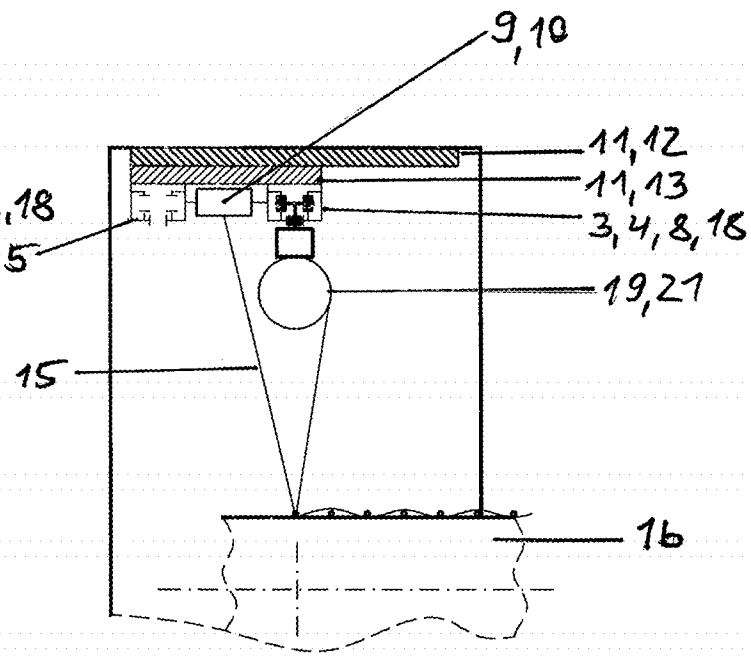

FIG. 9 shows a fourth design of the circular loom according to the invention for weaving a cylindrical weaving core 1*b*.

The design of the guide devices 11 is intended in further development of the design and arrangement of the guide devices 11 of FIGS. 1, 2*a, b*, so that in this regard, the above description for the first design of the circular loom also applies in respect of the matching features and their advantages of the guide devices 11 to the circular loom described here according to the fourth design, with the result that in this regard reference is made to the corresponding statements.

To avoid repetition, only the differences compared to the first design of the circular loom according to FIGS. 1, 2*a, b* are described below.

In this design, the 12 warp spool devices 9 are in each case arranged in a gap between a track segment pair 5, 18 which pair is arranged in each case on one movable guide carriage 13 of the 12 guide devices 11.

Each warp spool device 9 is fastened on both sides to the facing side walls of the first and second track segment 5, 18 and is therefore indirectly carried with the guide carriage 13 of the guide device 11.

The provided warp thread 15 of the warp spool device 9 can be directly led away from the warp thread spool 10 and fed to the weaving point on the weaving core 1*b*, while at the same time for the necessary alternating change of sides of the warp thread 15, it is carried by the axial movement of the guide carriage 13.

Thus the guide carriage 13 according to this design advantageously does not require a thread channel or thread outlet for guiding and letting out the warp thread 15.

FIG. 9 shows the operating phase of the circular loom, in which among other things the guide carriage 13 of the guide device 11 arranged in the 12 o'clock position with the warp spool device 9 and its warp thread 15 as well as the first track segment 5 (in standby position) is located in the image plane to the left of the orbit path 3, while the shuttle 19 passes through the 12 o'clock position.

In the fourth design of the circular loom according to FIG. 9, unlike the first design according to FIGS. 1, 2*a, b* the weaving of a weaving core 1*b* with a uniform, cylindrical core cross-section in accordance with the second designs according to FIGS. 3 to 5 is intended, which is why reference is made in this regard to the corresponding description.

Figures 10A, 10B:
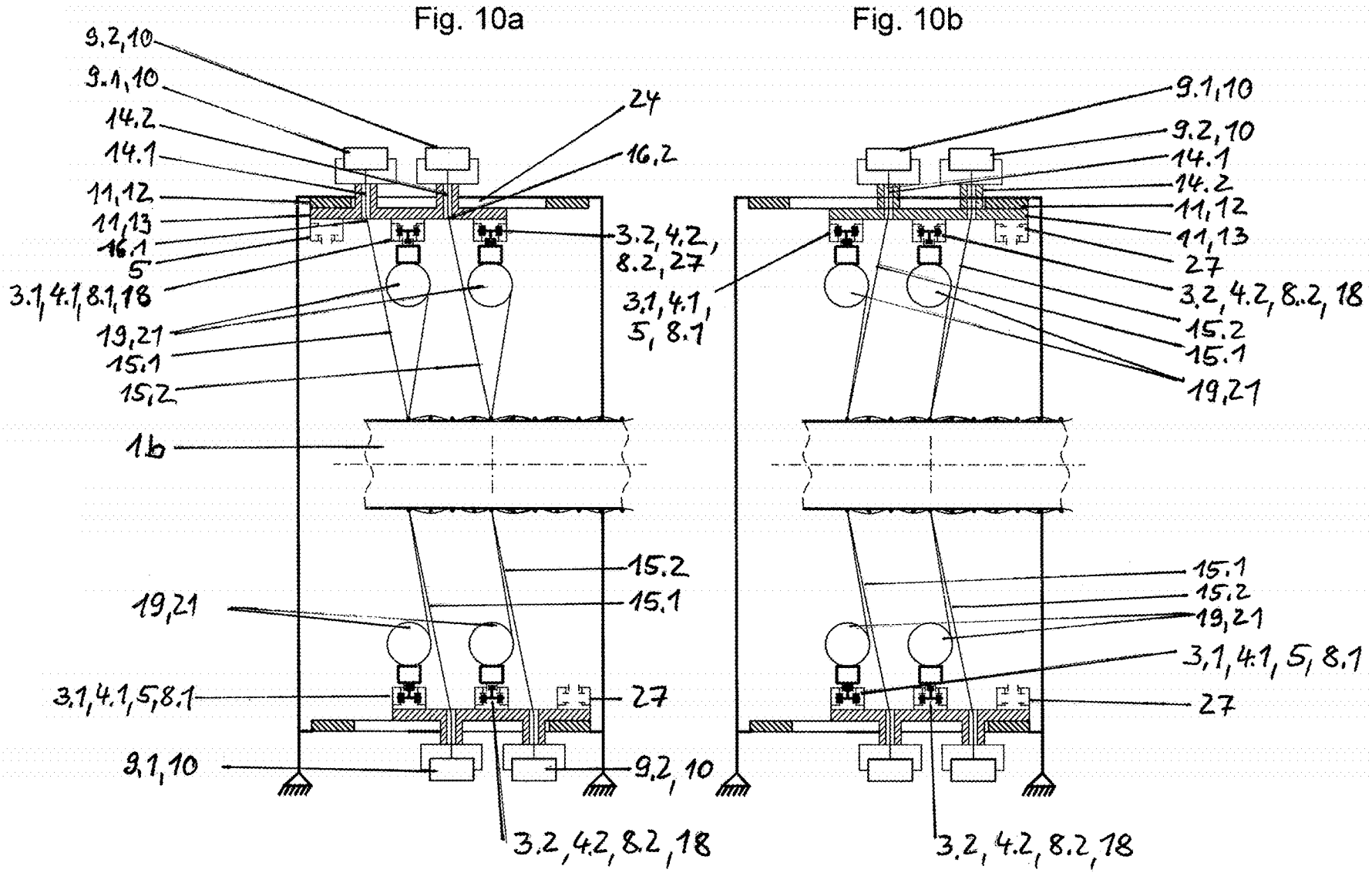

FIGS. 10*a, b* show a fifth design of the circular loom according to the invention for weaving a cylindrical weaving core 1*b*.

The above description for the third design of the circular loom also applies in respect of the matching features and their advantages to the circular loom described here according to the fifth design, with the result that in this regard reference is made to the corresponding statements.

To avoid repetition, only the differences compared to the third design of the circular loom according to FIGS. 6, 7*a, b* are described.

The circular loom according to this example embodiment has two circular orbit paths 3.1, 3.2 arranged parallel to each other for the rail-guided orbit of in each case two shuttles 19, where the second circular orbit path 3.2 and its track segments 18 are designed identically to the first orbit path 3.1 and its track segments 5.

The track segments 18 of the second orbit path 3.2 are the track segments 18 that are alternatively assignable to the first orbit path and are adjacent to the first track segments 5.

Corresponding to the number of track segments 5 of the first orbit path 3.1 and the number of track segments 18 of the second orbit path 3.2, on the respective guide carriages 13 in each case identically designed third track segments 27 are arranged, which have a matching guide rail 7 with in each case three rail segment pairs 7, all of which are parallel to the track segments 18 of the second orbit path 3.2 and their rail segment pairs 7 are equally axially spaced.

The track segments 18 of the second orbit path 3.2 are furthermore referred to as second track segments 18 and the track segments 27 adjacent to the second track segments 18 of the second orbit path 3.2 are furthermore referred to as third track segments 27.

In each case, a first track segment 5 of the first orbit path 3.1, a second track segment 18 of the second orbit path 3.2 and an adjacent third track segment 27 are arranged together on a guide carriage 13 of the 12 guide devices 11 and are carried and positioned with this guide carriage.

The circular loom furthermore has 24 warp spool devices 9 each with 24 warp thread spools 10, which are arranged in pairs on in each case an axially moving guide carriage 13 of the 12 guide devices 11, where the two warp spool devices 9.1, 9.2 are each held on a radially extended shaft of the guide carriage 13 and are thus carried with the guide carriage 13.

The guide carriage 13 contains, for guiding in each case one warp thread 15 of the two warp threads 15.1, 15.2 provided from the two carried warp spool devices 9.1, 9.2, two radially extended thread channels 14.1, 14.2 which are in each case designed in a shaft and in each case end in a thread outlet 16.1, 16.2, where the first thread channel 14.1 or thread outlet 16.1 is arranged at a middle distance between the first and second track segment 5, 18 and the second thread channel 14.2 or thread outlet 16.2 is arranged at a middle distance between the second and third track segment 18, 27.

In this design also, the warp spool devices 9.1, 9.2 are arranged so that their warp thread spools 10 are located essentially in a straight-line extension to the radially directed thread channels 14.1, 14.2 and hence always enable a deflection-free path of the warp thread 15 through the respective thread channel 14.

FIGS. 10*a, b* show two operating phases of the weaving process in the circular loom with alternating positioning of the guide carriages 13 with the warp spool devices 9 while both shuttles 19 in the two orbit paths 3.1, 3.2 travel around their orbit in each case by 180°.

In the operating phase according to FIG. 10*a* both the orbiting shuttles 19 of the two orbit paths 3.1, 3.2 are located in the in 6 o'clock and in the 12 o'clock position of the circular loom, where while forming two warp thread sheds among other things the guide carriage 13 of the guide device 11 arranged in the 12 o'clock position is shifted to the left in the image plane in such a way that the first warp spool device 9.1 with the first warp thread 15.1 and the first track segment 5 is positioned to the left of the first orbit path 3.1, where the first track segment acts in standby position and the first orbit path 3.1 is alternatively closed by the second track segment 18, and furthermore the second warp spool device 9.2 with the second warp thread 15.2 is positioned between the first and second orbit path 3.1, 3.2, where the second orbit path 3.2 is alternatively closed by the adjacent third track segment 27, while the shuttles 19 of both orbit paths 3.1, 3.2 pass through the 6 o'clock and 12 o'clock position.

While forming two additional warp thread sheds, in the operating phase according to FIG. 10*a* among other things the guide carriage 13 of the guide device 11 arranged in the 6 o'clock position is shifted to the right in the image plane in such a way that the second warp spool device 9.2 with the second warp thread 15.2 and the third track segment 27 is positioned to the right of the second orbit path 3.2, where the third track segment 27 acts in standby position and the second orbit path 3.2 is closed in the regular manner by the second track segment 18, and furthermore the first warp spool device 9.1 with the first warp thread 15.1 is positioned between the first and second orbit path 3.1, 3.2, where the first orbit path 3.1 is closed in the regular manner by the first track segment 5, while the shuttles 19 of both orbit paths 3.1, 3.2 pass through the 6 o'clock and 12 o'clock position.

In the operating phase according to FIG. 10*b*, the shuttles 19 that were previously located in the 6 o'clock position of the two orbit paths 3.1, 3.2 pass through the 12 o'clock position and vice versa.

Among other things the guide carriages 13 of the guide devices 11 arranged in the 6 o'clock and 12 o'clock position are together shifted in the image plane to the right in such a way that the second warp spool device 9.2 with the second warp thread 15.1 and the third track segment 27 is positioned to the right of the second orbit path 3.2, where the third track segment 27 acts in standby position and the second orbit path 3.2 is closed in the regular manner by the second track segment 18, and furthermore the respective first warp spool device 9.1 with the first warp thread 15.1 is positioned between the first and second orbit path 3.1, 3.2, where the first orbit path 3.1 is closed in the regular manner by the first track segment 5, while the shuttles 19 of both orbit paths 3.1, 3.2 pass through the 6 o'clock and 12 o'clock position.

During the axial shifting of the guide carriage 13 to the left or right in the image plane, in each case the warp thread 15.1 of the first warp spool device 9.1 crosses the first track plane 8.1 of the first orbit path 3.1, whereas the warp thread 15.2 of the second warp spool device 9.2 crosses the second track plane 8.1 of the second orbit path 3.2.

In the design of the circular loom according to the fifth example embodiment, an even greater number of possible weaving modes and weaving structures can be realised while maintaining a high weaving speed and weaving quality.

LIST OF REFERENCE NUMERALS

1 Weaving core, non-uniform a, cylindrical b
2 Weaving axis of the circular loom
3 Circular orbit path, first .1, second .2
4 Track body first .1, second .2
Track segment, first
6 Machine housing
7 Guide rail
8 Track plane, first .1, second .2
9 Warp spool devices, first .1, second .2
Warp thread spool
11 Guide device
12 Base body of the guide device
13 Positioning part, guide carriages
14 Thread guide element, thread guide channel, thread channel, first .1, second .2
15 Warp thread, first .1, second .2
16 Thread outlet, first .1, second .2
17 Weaving core axis
18 Track segment, second
19 Shuttle
20 Shuttle carriage
21 Weft thread spool
22 Weft thread
23 Guide roller
24 Passage in the base body
25 Fabric
26 Weaving ring
27 Track segment, third

What is claimed is:

1. A circular loom for weaving a weaving core along a weaving axis with at least one shuttle, which comprises a warp thread spool and is movable along a circular orbit path around the weaving core, wherein the orbit path is formed of first track segments arranged one after the other along its circumference and at least one movably arranged or designed guide device is provided, which guides at least one warp thread provided from a warp thread spool of a warp spool device and on which at least one first track segment of the orbit path and at least one second track segment that is alternatively assignable to the orbit path are arranged and guided, where in a guided absence of the first and second track segment from the orbit path the guided warp thread, crossing the track plane, passes through the orbit path.

2. The circular loom of claim 1, wherein in each case a first track segment of the orbit path and a second track segment are designed identically to each other.

3. The circular loom of claim 1, wherein the movable guide device comprises at least one movably or pivotably arranged or designed positioning part.

4. The circular loom of claim 1, wherein a thread guide element of the guide device is configured as a thread guide channel, as a thread guide groove or as a thread guide eye.

5. The circular loom of claim 3, wherein the positioning part of the guide device is configured to be linearly movable.

6. The circular loom of claim 3, wherein a warp thread spool of at least one warp spool device is arranged essentially in a straight extension of a path of the warp thread through the thread guide element and/or essentially in a straight extension of a travel or pivot path of the thread guide element.

7. The circular loom of claim 1, wherein the warp thread spool of at least one warp spool device is arranged essentially in a lengthening of a radial extent of the circular orbit path.

8. The circular loom of claim 1, wherein at least one warp spool device is arranged on the guide device and/or on a first track segment and/or a second track segment.

9. The circular loom of claim 1, wherein the circular orbit path comprises at least one guide rail or is formed by at least one guide rail, in or on which at least one shuttle is guided.

10. The circular loom of claim 1, wherein a guiding and/or a drive of the shuttle is magnetic and/or electromagnetic.

11. The circular loom of claim 1, wherein a second circular orbit path is provided, along which in each case at least one shuttle is movable, the second circular orbit path being formed of second track segments arranged one after the other along its circumference, where the guide device guides a second warp thread provided from a second warp thread spool of a second warp spool device and on which at least one third track segment alternatively assignable to the second orbit path is arranged and guided, where in a guided absence of the second and third track segment from the second orbit path the second guided warp thread, crossing the second track plane, passes through the second orbit path.

12. The circular loom of claim 11, wherein in each case a second track segment of the second orbit path and a third track segment are designed identically to each other.

* * * * *